US008713866B2

(12) United States Patent
Gadoury

(10) Patent No.: US 8,713,866 B2
(45) Date of Patent: May 6, 2014

(54) HINGE REINFORCED FRAME ASSEMBLY

(76) Inventor: Alain Gadoury, Port Coquitlam (CA)

( * ) Notice: Subject to any disclaimer, the term of this patent is extended or adjusted under 35 U.S.C. 154(b) by 0 days.

(21) Appl. No.: 13/403,685

(22) Filed: Feb. 23, 2012

(65) Prior Publication Data

US 2013/0219813 A1 Aug. 29, 2013

(51) Int. Cl.

| | |
|---|---|
| ***E06B 1/04*** | (2006.01) |
| ***E06B 1/12*** | (2006.01) |
| ***E06B 1/56*** | (2006.01) |
| *E06B 3/263* | (2006.01) |

(52) U.S. Cl.

CPC ... *E06B 1/04* (2013.01); *E06B 1/12* (2013.01); *E06B 1/56* (2013.01); *E06B 2003/26352* (2013.01)

USPC ..... 52/211

(58) Field of Classification Search

CPC ..... E06B 1/04; E06B 1/12; E06B 1/36; E06B 1/52; E06B 1/56; E06B 1/60; E06B 2001/62; E06B 2003/26352; E06B 2003/26363

USPC ..... 52/205, 211, 212, 656.1, 656.2, 656.7, 52/656.4

See application file for complete search history.

(56) References Cited

U.S. PATENT DOCUMENTS

| | | | | | |
|---|---|---|---|---|---|
| 1,266,546 | A | * | 5/1918 | Baxter | 52/211 |
| 1,301,930 | A | * | 4/1919 | Gogay | 52/211 |
| 1,806,647 | A | * | 5/1931 | Rose | 52/213 |
| 1,821,254 | A | * | 9/1931 | Baum | 52/213 |
| 2,818,947 | A | * | 1/1958 | Goldberg | 52/211 |
| 3,654,731 | A | * | 4/1972 | Jellinek | 49/504 |
| 3,924,373 | A | * | 12/1975 | Lizdas et al. | 52/213 |
| 4,179,849 | A | * | 12/1979 | Kuffner | 49/505 |
| 4,223,494 | A | * | 9/1980 | Wendt | 52/211 |
| 4,226,066 | A | * | 10/1980 | Persson | 52/211 |
| 4,281,480 | A | * | 8/1981 | Wendt | 49/504 |
| 4,281,481 | A | | 8/1981 | Wendt | |
| 4,674,248 | A | * | 6/1987 | Hall | 52/212 |
| 4,829,727 | A | | 5/1989 | Kuzara, Jr. | |
| 4,930,257 | A | * | 6/1990 | Windgassen | 49/504 |
| 4,993,204 | A | * | 2/1991 | Kuritsky et al. | 52/309.15 |
| 5,193,308 | A | | 3/1993 | Davidian | |
| 5,596,851 | A | * | 1/1997 | Ting | 52/211 |

(Continued)

FOREIGN PATENT DOCUMENTS

| | | |
|---|---|---|
| EP | 0422707 A1 | 4/1991 |
| EP | 0432339 A1 | 6/1991 |

(Continued)

OTHER PUBLICATIONS http://www.alibaba.com/product-gs/476597290/2011_aluminum_door_frame.html.

*Primary Examiner* — Mark Wendell
*Assistant Examiner* — Keith Minter
(74) *Attorney, Agent, or Firm* — G. F. Gallinger

(57) ABSTRACT

A frame assembly includes an elongate frame jamb and an elongate hinge reinforcement member, the elongate hinge reinforcement member being secured to the elongate frame jamb such that the elongate frame jamb may be vertically supportable by the elongate hinge reinforcement member at a reinforcement member base end. The elongate hinge reinforcement member is retained within a jamb longitudinal channel formed by the elongate frame jamb. The elongate hinge reinforcement may be configured to include mounting holes located substantially equidistant between side reinforcement walls of the elongate hinge reinforcement member.

17 Claims, 11 Drawing Sheets

(56) References Cited

U.S. PATENT DOCUMENTS

| | | | | |
|---|---|---|---|---|
| 5,619,823 | A * | 4/1997 | Ruff et al. | 49/504 |
| 5,687,518 | A * | 11/1997 | Endo et al. | 52/204.1 |
| 5,836,118 | A * | 11/1998 | Thornton et al. | 52/204.1 |
| 6,293,060 | B1 * | 9/2001 | McKann et al. | 52/211 |
| 6,393,780 | B1 * | 5/2002 | Jung | 52/211 |
| 6,405,506 | B2 * | 6/2002 | Ruff | 52/656.4 |
| 6,430,889 | B1 | 8/2002 | Nixon, Sr. | |
| 6,467,226 | B2 * | 10/2002 | Dodson et al. | 52/220.1 |
| 6,826,877 | B1 * | 12/2004 | Stradel | 52/211 |
| 6,857,232 | B2 * | 2/2005 | Bealko | 52/211 |
| 6,922,959 | B1 * | 8/2005 | Hileman | 52/212 |
| 7,174,691 | B2 * | 2/2007 | de Garay Arellano | 52/716.1 |
| 7,621,083 | B2 * | 11/2009 | Smith | 52/212 |
| 7,716,886 | B2 * | 5/2010 | Gordon | 52/213 |
| 7,739,850 | B2 * | 6/2010 | Daudet | 52/656.2 |
| 8,109,053 | B2 * | 2/2012 | Smith | 52/212 |
| 8,112,968 | B1 * | 2/2012 | Mueller | 52/800.12 |
| 8,201,368 | B2 * | 6/2012 | Nirel et al. | 52/213 |
| 2005/0193652 | A1 * | 9/2005 | Cornell | 52/204.1 |
| 2007/0074469 | A1 * | 4/2007 | Plagemann et al. | 52/204.1 |
| 2008/0072506 | A1 * | 3/2008 | LeGoff | 52/204.1 |
| 2008/0256881 | A1 * | 10/2008 | Lowry et al. | 52/212 |
| 2009/0178361 | A1 * | 7/2009 | Chen | 52/656.2 |
| 2009/0178369 | A1 * | 7/2009 | Pilz et al. | 52/781.3 |
| 2010/0139187 | A1 * | 6/2010 | Medina et al. | 52/204.1 |
| 2011/0314754 | A1 * | 12/2011 | Griffin | 52/204.2 |
| 2012/0137605 | A1 * | 6/2012 | Sibbett | 52/204.1 |

FOREIGN PATENT DOCUMENTS

| | | | |
|---|---|---|---|
| EP | 0656457 | A2 | 6/1995 |
| EP | 0666397 | A1 | 8/1995 |
| EP | 0708585 | A2 | 4/1996 |
| EP | 0708585 | A3 | 6/1996 |
| EP | 0706019 | A3 | 6/1997 |
| EP | 0671519 | A3 | 10/1997 |
| EP | 1792697 | A1 | 6/2007 |
| EP | 1921239 | A1 | 5/2008 |
| EP | 1961884 | A2 | 8/2008 |

* cited by examiner

HINGE REINFORCED FRAME ASSEMBLY

TECHNOLOGY FIELD

This patent application relates to a frame assembly with a hinged element. In particular, this patent application relates to a hinge reinforced frame assembly comprising a support member supporting a hinged element.

BACKGROUND

A frame assembly is used to mount to a wall, door, window, or other building elements that are not designed to be load bearing. A door or window may be attached to a door frame or window frame by one or more hinges allowing the door or window to be moved between various opened or closed positions in the frame. The frame is installed in an opening made in a wall, and typically the frame is secured to one or more partition walls such that the partition walls may bear the load of the frame and any door or window attached thereto.

Ruff et al. (U.S. Pat. No. 5,619,823) describes a metallic door fame having a bent sheet metal frame element encompassing an inner space. The element has backbends which extend perpendicularly inward from the back ends of faces of the element. At least one slidably insertable sleeve is disposed inside the element and has flanges which are spot welded to the back ends. The sleeves serve as carriers for various door hardware such as hinge reinforcement and strike plates, clips having bendable tabs, and anchors.

SUMMARY

As described in this patent application, the frame assembly comprises an elongate frame jamb and an elongate hinge reinforcement member, the elongate hinge reinforcement member being secured to the elongate frame jamb such that the elongate frame jamb is vertically supportable by the elongate hinge reinforcement member at the reinforcement base end. The elongate frame jamb may include a jamb base end, a jamb top end, a front jamb wall extending between the jamb base end and the jamb top end, at least one intermediate jamb wall extending from the front jamb wall, and an end jamb wall extending from the front jamb wall. The end jamb wall may be opposite one of the intermediate jamb walls. The front jamb wall, the one intermediate jamb wall, and the end jamb wall forming a jamb longitudinal channel. The elongate hinge reinforcement member may include a reinforcement base end, a reinforcement top end, and a front reinforcement wall extending between the reinforcement base end and the reinforcement top end. The elongate hinge reinforcement member may be retained within the jamb longitudinal channel.

In accordance with another aspect of the present invention, there is provided a frame assembly comprising an elongate frame jamb and an elongate hinge reinforcement member. The elongate frame jamb may include a front jamb wall, a jamb stud mounting wall configured to mount the frame assembly to a partition wall, at least one intermediate jamb wall extending between the jamb stud mounting wall and the front jamb wall, and an end jamb wall extending from the front jamb wall and being opposite one of the intermediate jamb walls. The front jamb wall, the one intermediate jamb wall, and the end jamb wall form a jamb longitudinal channel. The elongate hinge reinforcement member may be retained within and secured to the jamb longitudinal channel. The elongate hinge reinforcement member includes a front reinforcement wall and a pair of spaced-apart side reinforcement walls extending from the front reinforcement wall. The front reinforcement wall may include a set of mounting holes for securing a hinge plate thereto. The mounting holes may be located substantially equidistant between the side reinforcement walls.

In accordance with another aspect of the present invention, there is provided a door frame comprising a partition wall and a door frame assembly mounted to the partition wall. The door frame assembly may include an elongate frame jamb and an elongate hinge reinforcement member. The front jamb wall includes at least one jamb hinge aperture retaining a hinge plate therein, a jamb stud mounting wall mounted to the partition wall, at least one intermediate jamb wall extending between the jamb stud mounting wall and the front jamb wall, and an end jamb wall extending from the front jamb wall and being opposite one of the intermediate jamb walls. The front jamb wall, the one intermediate jamb wall, and the end jamb wall form a jamb longitudinal channel. The elongate hinge reinforcement member is retained within and secured to the jamb longitudinal channel. The elongate hinge reinforcement member may include a front reinforcement wall and a pair of spaced-apart side reinforcement walls extending from the front reinforcement wall. The front reinforcement wall includes a set of mounting holes retaining fasteners securing the hinge plate thereto. The mounting holes are aligned with the jamb hinge aperture and are located substantially equidistant between the side reinforcement walls.

BRIEF DESCRIPTION OF THE DRAWINGS

The aforementioned features will now be described, by way of example, with reference to the accompanying drawings, in which.

DETAILED DESCRIPTION

Figure 1:
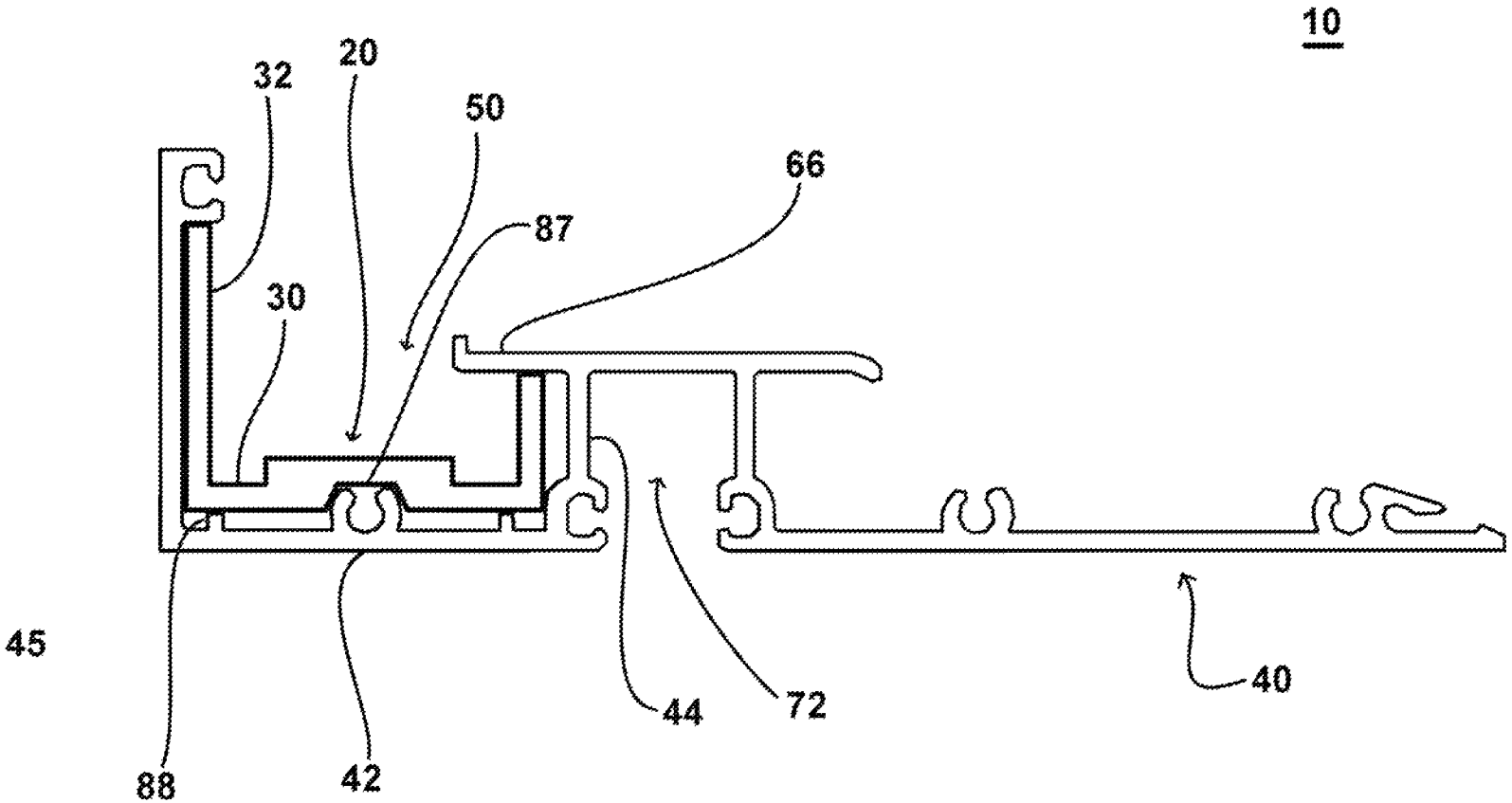
FIG. 1 is a top plan view of an implementation of the frame assembly according to an aspect of the present invention, showing an elongate hinge reinforcement member and elongate frame jamb together.

The drawings depict a frame assembly, denoted generally as 10, that comprises an elongate frame jamb 40 and an elongate hinge reinforcement member 20. The elongate hinge reinforcement member 20 is secured to the elongate frame jamb 40 such that the elongate frame jamb 40 may be vertically supportable by the elongate hinge reinforcement member 20 at the reinforcement base end 26. The elongate frame jamb 40 may include a jamb base end 48, a jamb top end 52, a front jamb wall 42 extending between the jamb base end and the jamb top end 52, at least one intermediate jamb wall 44 extending from the front jamb wall 42, and an end jamb wall 45 extending from the front jamb wall 42. The end jamb wall 45 may be opposite one of the intermediate jamb walls 44 such that the front jamb wall 42, the one intermediate jamb wall 44, and the end jamb wall 45 form a jamb longitudinal channel 50. The elongate hinge reinforcement member 20 may include a reinforcement base end 26, a reinforcement top end 28, and a front reinforcement wall 30 extending between the reinforcement base end 26 and the reinforcement top end 28. The elongate hinge reinforcement member 20 may be retained within the jamb longitudinal channel 50. The elongate hinge reinforcement member 20 may be used to support a hinge assembly 60 mounted thereto, the hinge assembly also being secured to a door or window that may be opened or closed within the frame assembly 10.

Figure 2:
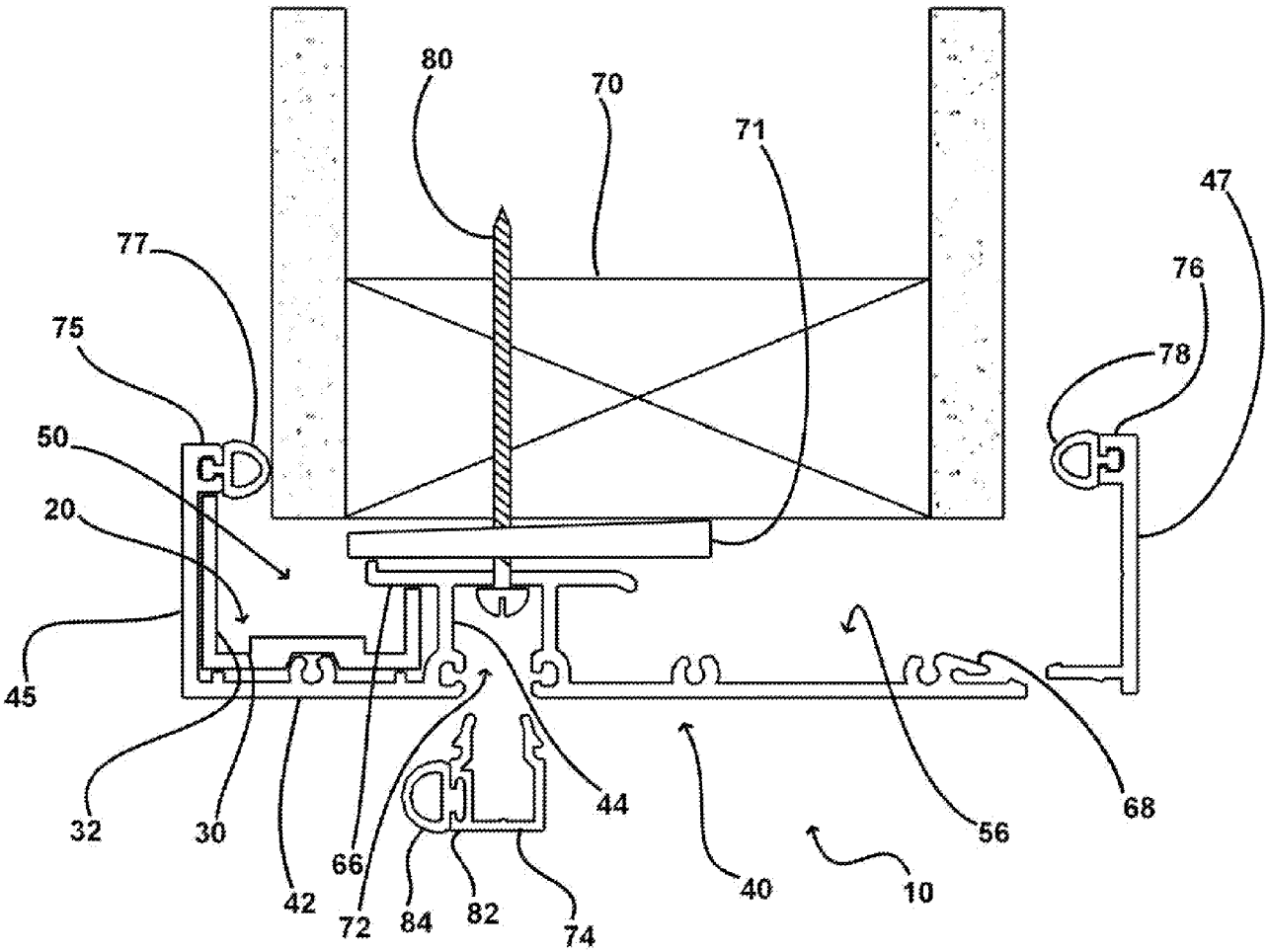
FIG. 2 is a top plan view of the frame assembly of FIG. 1 shown mounted to a partition wall.
Figure 3:
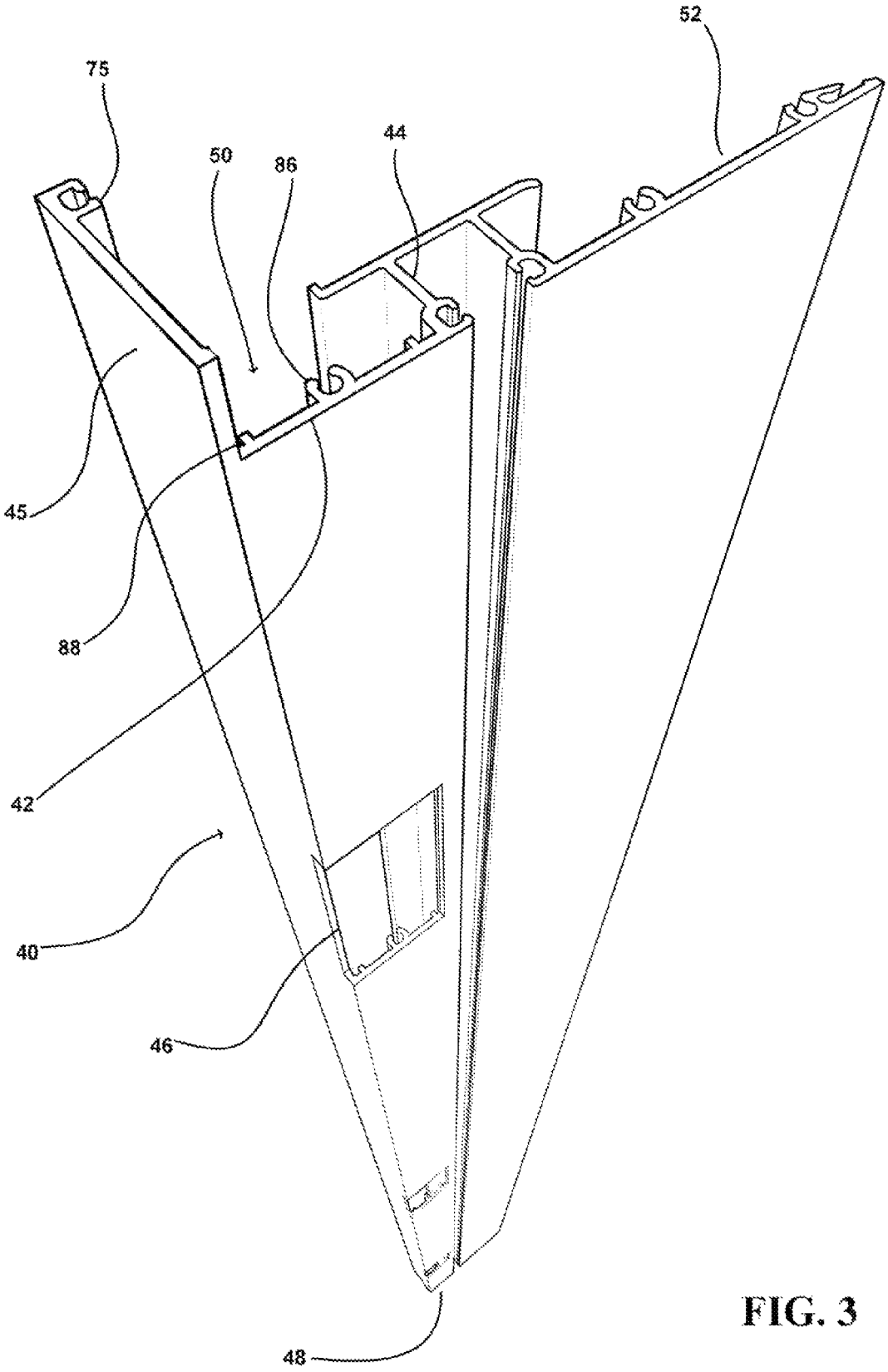
FIG. 3 is a front perspective view of the elongate frame jamb of the frame assembly of FIG. 1.

FIG. 1 shows an implementation of the frame assembly 10. As shown, the end jamb wall 45 may extend perpendicularly from the front jamb wall 42 opposing one of the intermediate jamb walls 44. In this implementation, a pair of intermediate jamb walls 44 are shown. The intermediate jamb walls 44 may also extend perpendicularly from the front jamb wall 42. The elongate frame jamb 40 may include a jamb stud mounting wall 66. The intermediate jamb walls 44 may be spaced-apart and extend between the jamb stud mounting wall 66 and the front jamb wall 42. The jamb stud mounting wall 66 may be configured to mount the frame assembly 10 to a partition wall 70 as shown in FIG. 2. Also, as shown in FIG. 3, the front jamb wall 42 may include at least one jamb hinge aperture 46 for receiving a hinge plate 62 therein. In this implementation, the frame assembly 10, partition wall 70, and hinge plate 62, shown in FIG. 8, may together form a door frame where the partition wall 70 is mounted to the jamb stud mounting wall 66, and the hinge plate 62 is retained in the jamb hinge aperture 46 (shown in FIG. 3), the hinge plate 62 secured to the front reinforcement wall 30 by fasteners 64 such as screws or nails. The fasteners 64 may be preferably 12 mm in length, or a number 12-24 screw. The intermediate jamb walls 44 with the front jamb wall 42 may effectively divide the frame jamb 40 into the jamb longitudinal channel 50 and a second jamb region 56. Accordingly, the jamb longitudinal channel 50 may occupy less than the entire width of the front jamb wall 42, or elongate frame jamb 40. The jamb longitudinal channel 50 may therefore be located offset from a midpoint of the elongate frame jamb 40. The elongate hinge reinforcement member, being retained within the jamb longitudinal channel 50, may be offset from a midpoint of the elongate frame jamb 40 as well.

The front jamb wall 42 is sized to cover an exposed surface of a partition wall 70 such that the partition wall 70 may be gripped between end jamb wall 45 and a removable second end jamb wall 47 that may be secured to an end of the front jamb wall 42 opposite the end jamb wall 45 as shown in FIG. 2. The partition wall 70 may include drywall and wall stud portions. The second end jamb wall 47 may be secured to front jamb wall 42 by a clipping means 68 formed on the front jamb wall 42 within the second jamb region 56. Alternatively, the second end jamb wall 47 may be secured to the front jamb wall 42 by glue, weld, or any other means resulting in the second end jamb wall 47 being capable of gripping the partition wall 70. Accordingly, each of the end jamb wall 42 and the second end jamb wall 47 may be substantially parallel to one another and to the partition wall 70 therebetween.

Each of the end jamb wall 42 and the second end jamb wall 47 may include an abutment 75 and 76, respectively spaced from the front jamb wall 42. The abutments 75 and 76 may be clip-shaped in order to receive and retain resilient elongate gaskets 77 and 78, inserted into abutments 75 and 76, respectively. The gaskets 77 and 78 may contact the partition wall 70 to create a seal between the frame assembly 10 and the partition wall 70, and hide internal portions of the frame assembly 10 from view once installed on the partition wall 70. The contact made between the gaskets 77, 78 and the partition wall 70 may also serve to limit lateral movement of the frame assembly 10. One or more partition wall screws 80 may also be inserted through the mounting wall 66 into the partition wall 70 to secure the frame assembly to the partition wall 70. The partition wall screws 80 may be distributed anywhere from the jamb base end to the jamb top end. Preferably, there are partition wall screws 80 screwed into the jamb stud mounting wall 66 through to the partition wall 70 at at least three vertically-spaced locations in the elongate frame jamb 40. More preferably, the screws 80 may be spaced substantially equidistantly from one another, and from the jamb base end 48 and jamb top end 52.

In the implementation shown in FIG. 2, the intermediate walls 44 may not measure as wide as the end jamb wall 42, thereby not extending as far towards the partition wall 70. The difference in width between the end jamb wall 42 and the intermediate wall 44 may be used as a tolerance distance to better align the frame assembly 10 to the partition wall 70. For example, not all walls or floors in a structure are always perfectly level, or they may shift over time. In a frame assembly 10 for mounting a hinged element such as a door or window, the frame assembly 10 is preferably substantially vertical so that the door or window does not open or close by only gravitational forces. Accordingly, the frame assembly 10 may not be exactly parallel with the partition wall 70. The tolerance distance allows for a varied amount of the partition wall screws 80 to be inserted into partition wall 70 thereby controlling the vertical angle of the frame assembly with respect to the partition wall 70. A stud mounting shim 71 may be inserted between the jamb stud mounting wall 66 and the partition wall 70 to securely space the partition wall 70 from the frame assembly 10. Partition wall screws 80 may be inserted through the stud mounting shim 71 as well.

In an implementation, as shown in FIG. 1, the spaced-apart intermediate jamb walls 44 may define an elongate jamb channel 72 therebetween. The elongate jamb channel may be configured to receive a door jamb stop 74 therein. The door jamb stop 74 may be secured by clips or other securing means formed within the elongate jamb channel 72. The door jamb stop 74 may include a stop clip abutment 82 oriented towards the side of the elongate frame jamb 40 housing the elongate hinge reinforcement member 20. When the hinge assembly is mounted to the elongate hinge reinforcement member 20, the hinge assembly is preferably installed to open away from the door jamb stop 74, and close by contacting a resilient stop gasket 84 inserted into stop clip abutment 82. The location of the elongate jamb channel 72 is dependent upon the location of the intermediate jamb walls 44. Accordingly the elongate jamb channel 72 may located anywhere along the front jamb wall 42.

Figure 4:
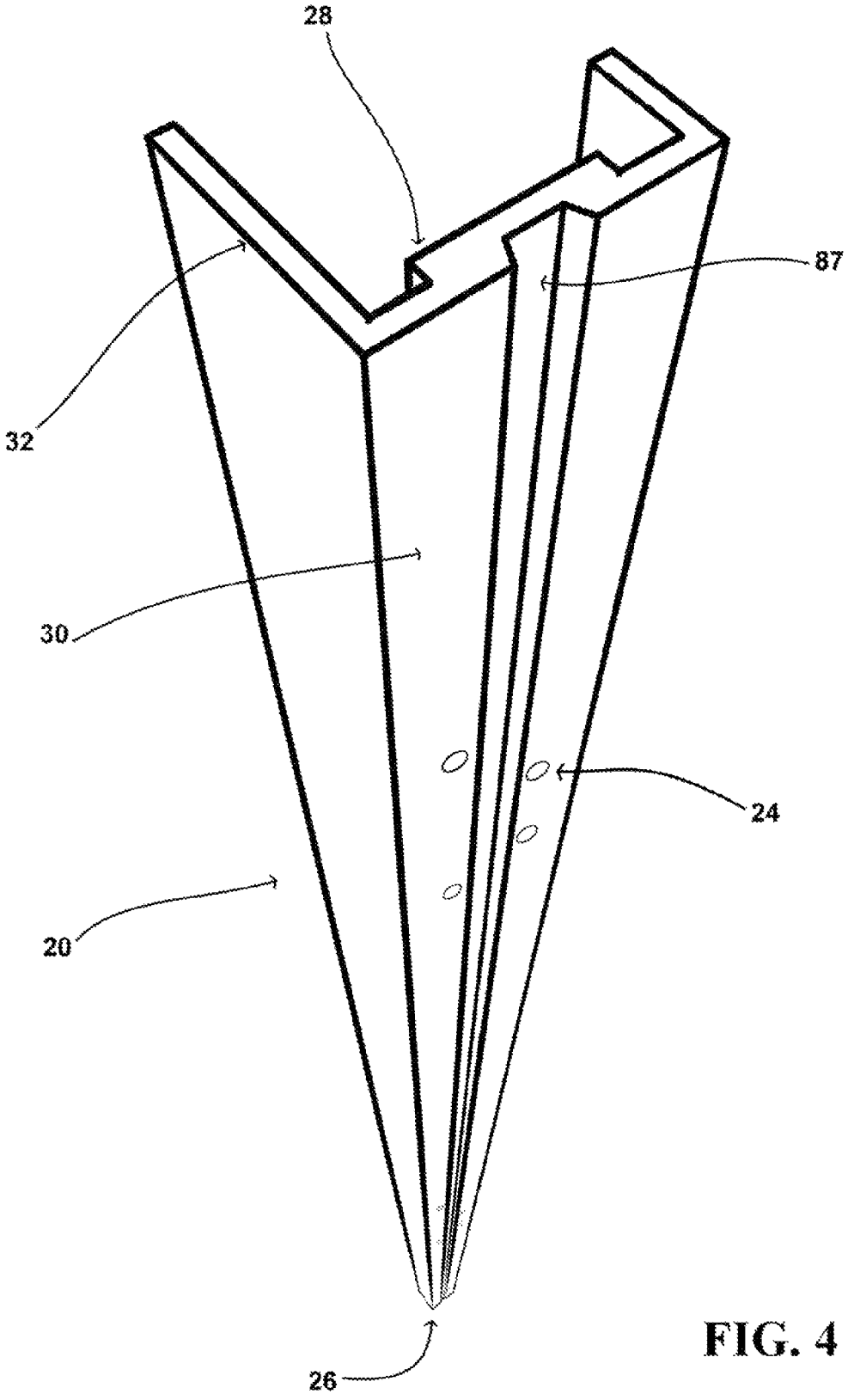
FIG. 4 is a front perspective view of the elongate hinge reinforcement member of the frame assembly of FIG. 1.
Figure 5:
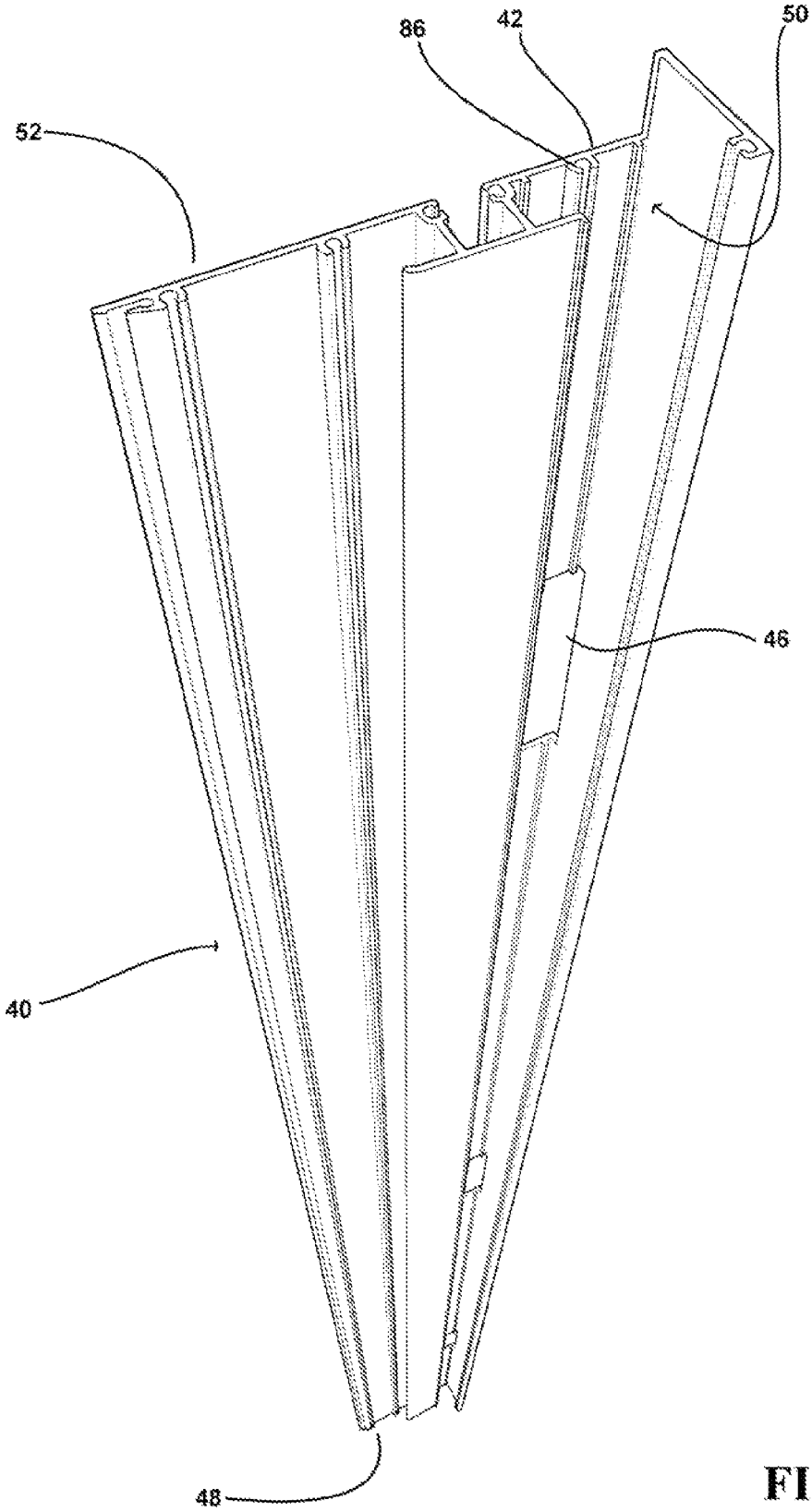
FIG. 5 is a rear perspective view of the elongate frame jamb of the frame assembly of FIG. 1.
Figure 6:
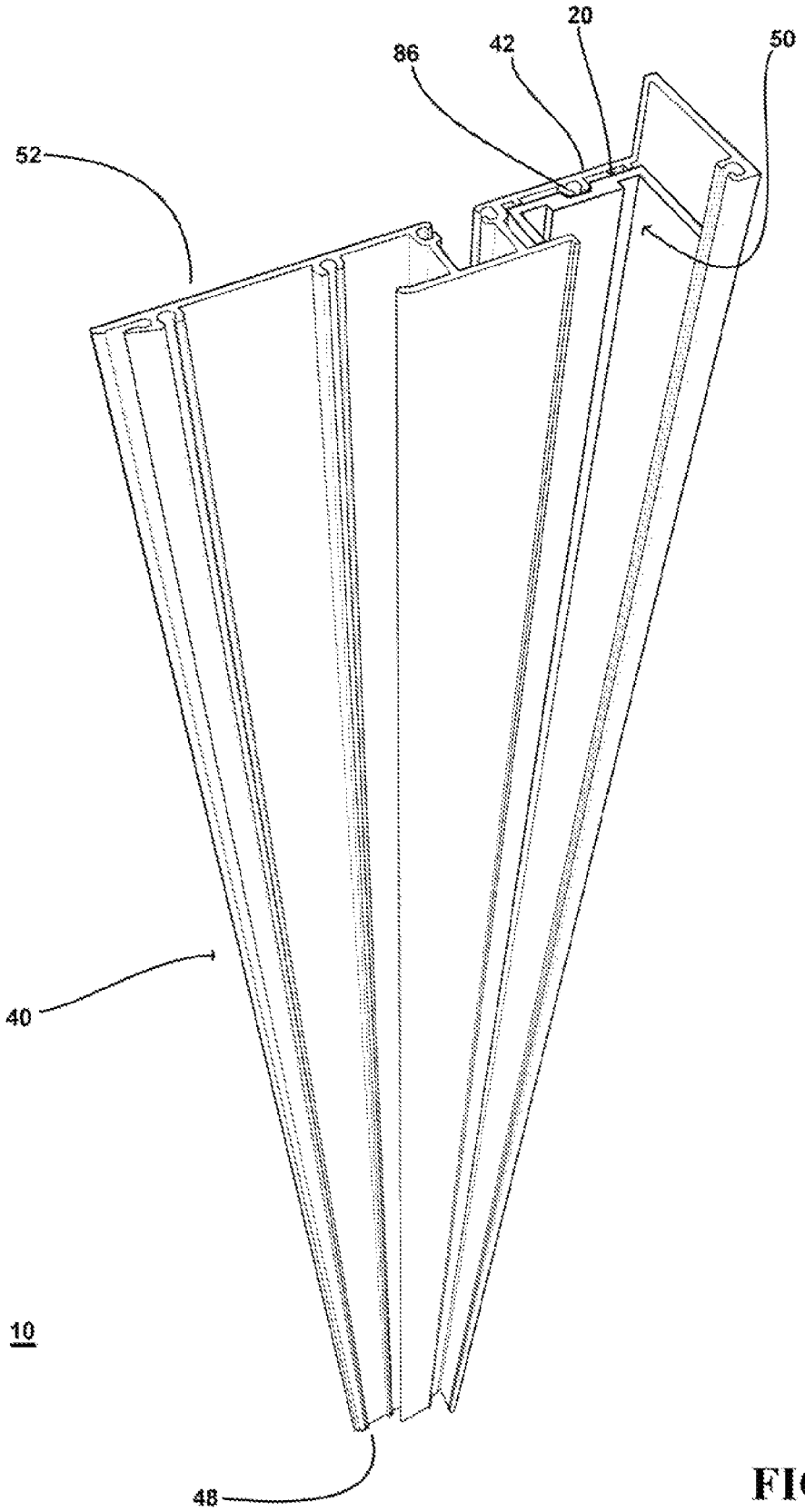
FIG. 6 is a rear perspective view of the frame assembly of FIG. 1.

In one implementation, as shown in FIG. 6, the entirety of the elongate hinge reinforcement member 20 (shown alone in FIG. 4) may be disposed within the jamb longitudinal channel 50 (the entirety of which is shown in FIGS. 3 and 5 with the elongate frame jamb 40 alone). The elongate hinge reinforcement member 20 may be best installed into this position by inserting into either the jamb base end 48 or the jamb top end 52, both of which being preferably open prior to installation, and sliding the elongate hinge reinforcement member 20 all the way until the reinforcement base end 26 is substantially aligned with the jamb base end 48. By installing in this way, the front reinforcement wall 30 is disposed against the front jamb wall 42. To assist with installation, optionally, the elongate frame jamb 40 may include at least one longitudinal guide rib 86 protruding into the jamb longitudinal channel 50 from one of the front jamb wall 42, intermediate jamb wall 44, and end jamb wall 45 forming the longitudinal channel 50. The elongate hinge reinforcement member 20 may also include a longitudinal guide notch 87 configured to receive the longitudinal guide rib 86. The mating between the longitudinal guide notch 87 and longitudinal guide rib 86 may aid in aligning the elongate hinge reinforcement member 20 with the elongate frame jamb during installation, in addition to aiding in retaining the elongate hinge reinforcement member 20 within the jamb longitudinal channel 50. The guide rib 86 may have a radial measurement of approximately 4.75 mm, and a diameter of approximately 9.5 mm.

In one implementation, as shown in FIG. 1, the elongate hinge reinforcement member 20 may include a pair of spaced-apart side reinforcement walls 32. Each side reinforcement wall 32 may extend from the front reinforcement wall 30 and may be disposed against one of the at least one intermediate jamb walls 44 and the end jamb wall 45. Where the one intermediate jamb wall 44 is not as wide as the end jamb wall 45, the side reinforcement wall 32 disposed against the one intermediate jamb wall 44 is preferably sized to be not as wide as the side reinforcement wall 32 disposed against the end jamb wall 45. In other words, the end jamb wall 45 may extend from the front jamb wall farther than either of the intermediate jamb walls 44. In addition to allowing for a tolerance in mounting the frame assembly 10 to the partition wall 70, providing a wider side reinforcement wall 32 disposed against end jamb wall 45 also may increase the reinforcing strength of the elongate reinforcement member 20 when supporting a hinge assembly 60 including a hinge plate 62 mounted thereto. Hinge assembly 60 may be configured as a butt hinge. In another implementation, the jamb stud mounting wall 66 may extend towards the jamb end wall 45 beyond the one of the intermediate walls 44 defining the jamb longitudinal channel, as shown in FIG. 1. In this way, the jamb stud mounting wall 66 may also further define the jamb longitudinal channel 50 and the respective side reinforcement wall 32 disposed proximate the one intermediate jamb wall 44 may be gripped or secured between the jamb stud mounting wall 66 and the front jamb wall 42. Each side reinforcement wall 32 may be about 3 mm in depth. The side reinforcement wall 32 disposed near the one intermediate jamb wall 44 may be about 15.4 mm in width while the opposing side reinforcement wall 32 may be about 32.2 mm in width, providing for a mounting tolerance of about 16.8 mm. The front reinforcement wall 30 may be about 39 mm wide. Each side reinforcement wall 32 may be secured to the respective one of the at least one intermediate jamb walls 44 and the end jamb wall 45 by glue or cold weld.

Figure 7A:
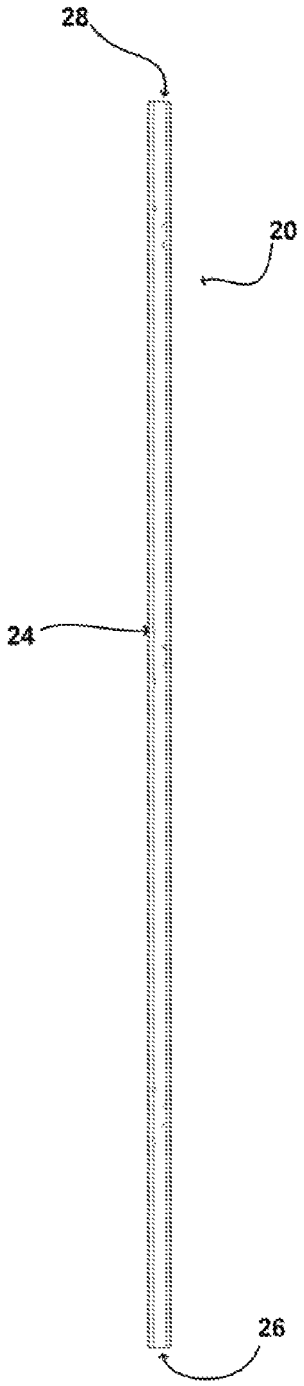
FIG. 7A is a front elevation view of the elongate hinge reinforcement member of the frame assembly of FIG. 1.
Figure 7B:
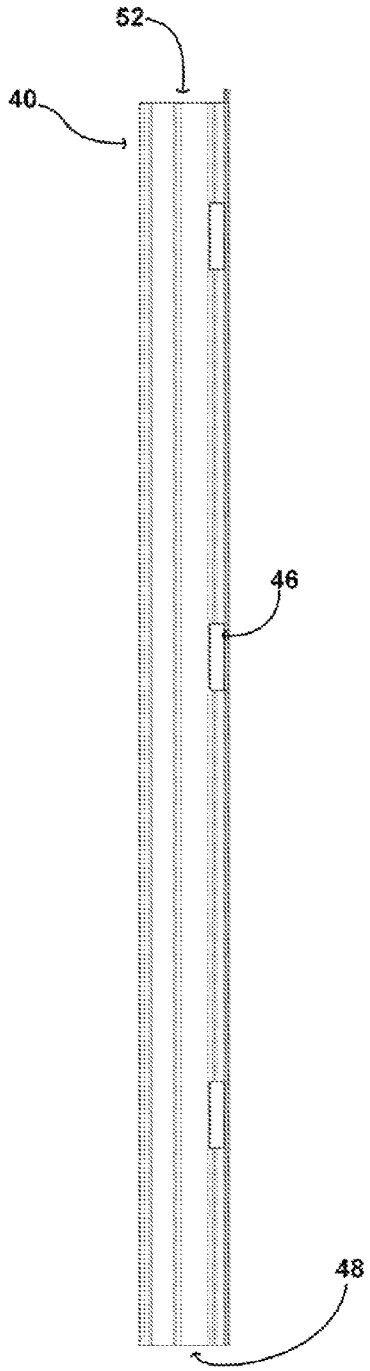
FIG. 7B is a rear elevation view of the elongate frame jamb of the frame assembly of FIG. 1.
Figure 7C:
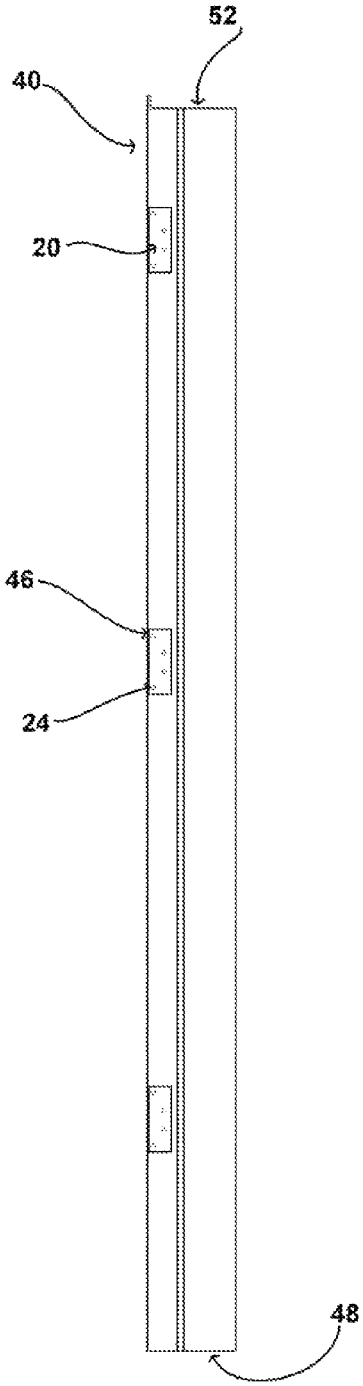
FIG. 7C is a front elevation view of the frame assembly of FIG. 1.
Figure 8:
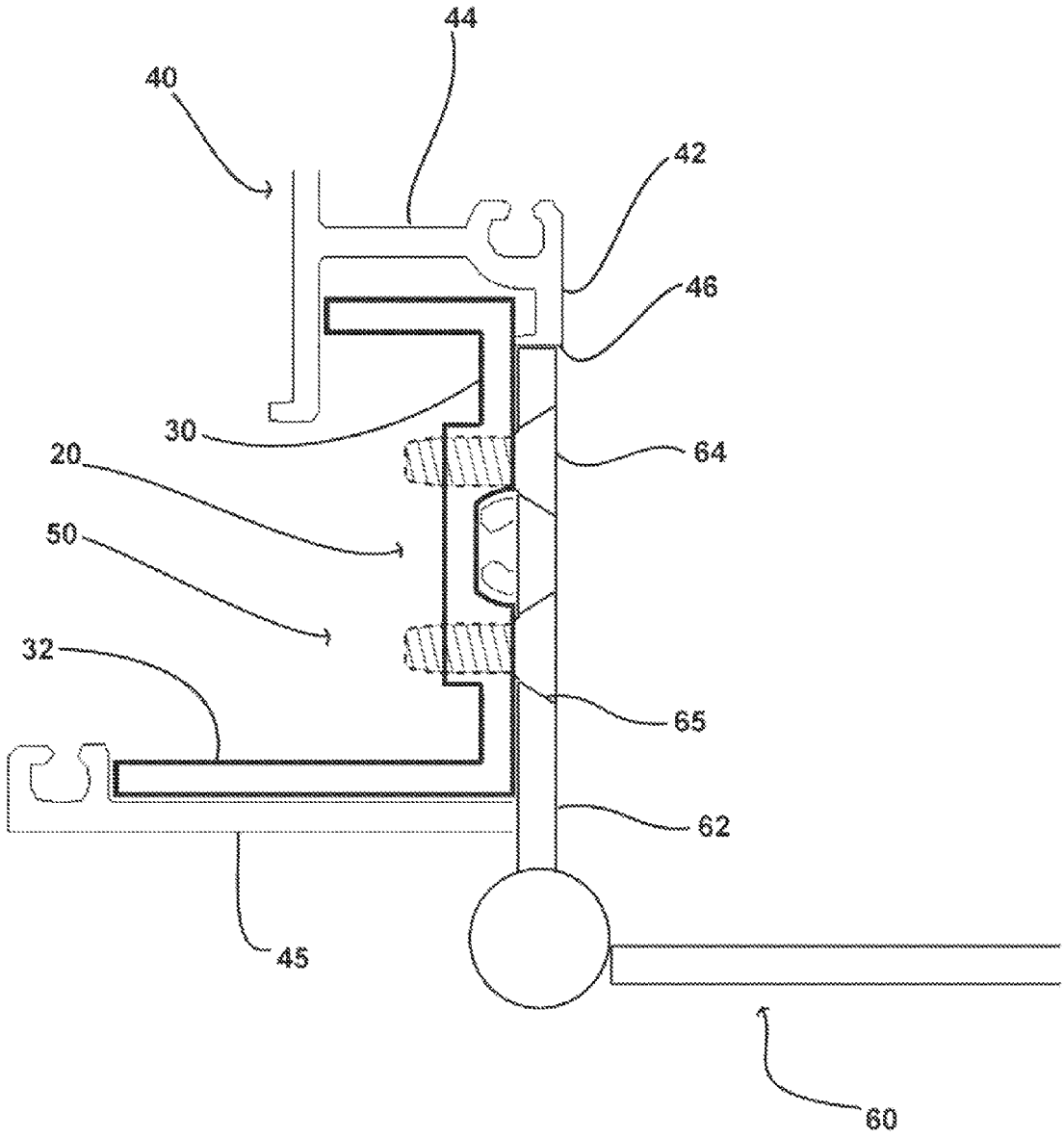
FIG. 8 is a partial top plan view of the frame assembly of FIG. 1 showing a portion of the elongate frame jamb, the elongate hinge reinforcement member and a hinge plate mounted thereto.

As shown in FIGS. 7A and 7C, the elongate hinge reinforcement member 20 may further comprise a set of mounting holes 24 for securing the hinge assembly 60 thereto, and as shown in FIG. 7C the mounting holes 24 may be aligned with the jamb hinge aperture 46 and are located substantially equidistantly between the side reinforcement walls 32 (as shown in FIGS. 4 and 7A). Preferably, the mounting holes 24 may be distributed in equal number on either side of the longitudinal guide notch 87, or where the longitudinal guide notch 87 would be located if not formed into the elongate hinge reinforcement member 20. Accordingly, the mounting holes 24 closest to either of the side reinforcement walls 32 may be spaced by about 5 mm to about 6 mm from the respective nearest side reinforcement wall 32. As shown in FIGS. 3, 7B, and 8, the jamb hinge aperture 46 may be a hinge plate-shaped cut-out formed in the front jamb wall 44 such that an entirety of the hinge plate 62 may be inserted through the jamb hinge aperture 46 to contact the hinge reinforcement member 20. Hinge plate 62 may include a standard arrangement of hinge plate screw holes 65. The mounting holes 24 may be formed into the front reinforcement wall 30 by drilling prior to assembly or installation. The mounting holes 24 preferably are sized and arranged according to the standard arrangement of hinge plate screw holes 65, although any arrangement of mounting holes 24 may be formed into the reinforcement wall 30 as required by the desired hinge assembly 60 to be used. The hinge plate 62 may be available in a range of thicknesses. It may be preferable to flush-mount the hinge plate 62 with the elongate frame jamb such that a substantially flat transition of around 1 mm or less in depth is created between the front jamb wall 42 and the hinge plate 62 when mounted to the elongate reinforcement member 20. One way in which this may be achieved is by including at least one guide butt 88 disposed along the front jamb wall 42 within the jamb longitudinal channel 50 to space the front reinforcement wall 30 from the front jamb wall 42 by a distance that when combined with the thickness of the front jamb wall 42 is substantially equivalent to the thickness of the hinge plate 62. These guide butts 88 may be cut either during manufacturing of the elongate hinge reinforcement member 20 or upon installation of the frame assembly 10.

In another implementation, one of the side reinforcement walls 32 may be gripped or secured between the front jamb wall 42 and the abutment 75 formed in the end jamb wall 45.

Figure 9:
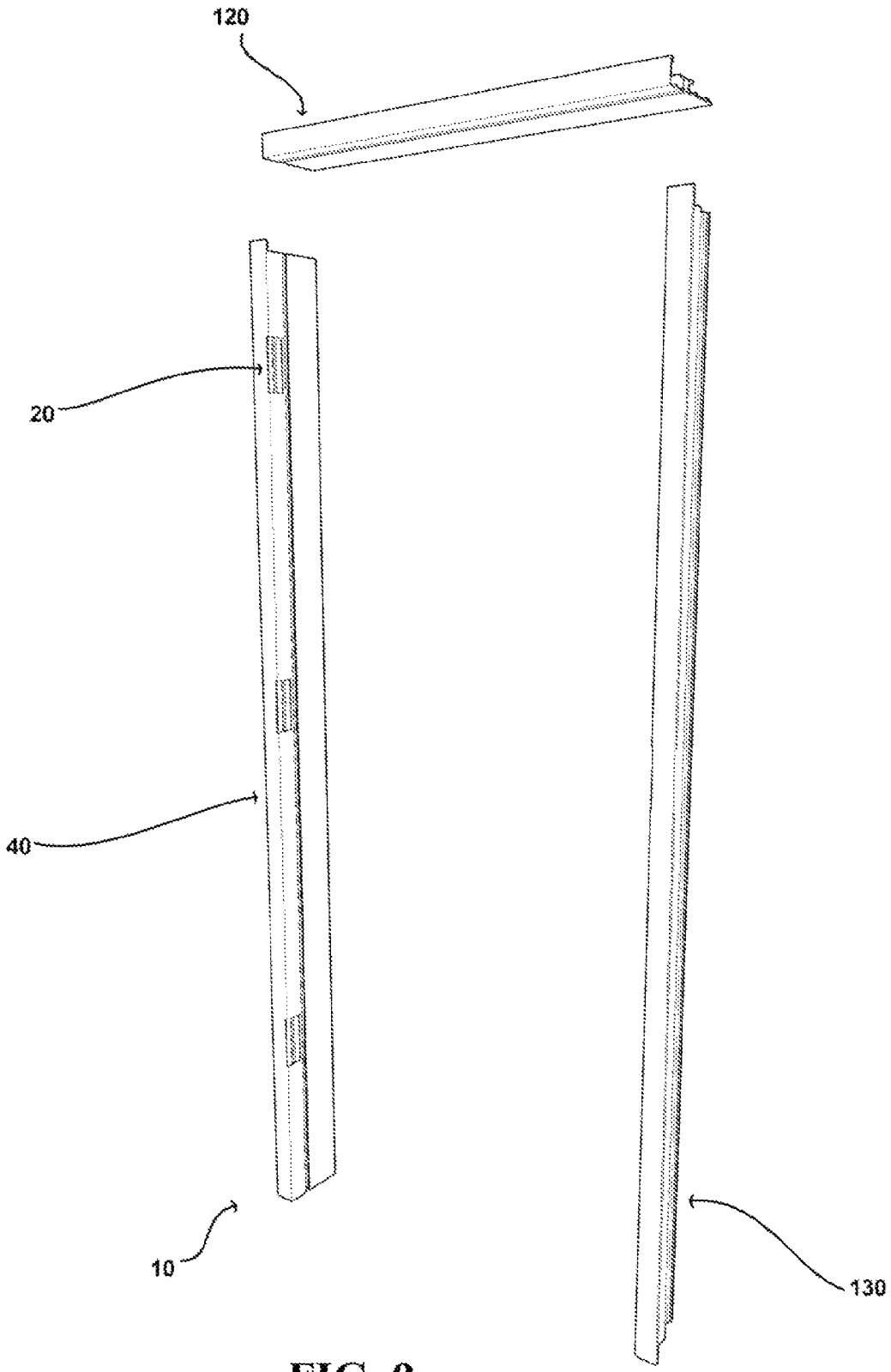
FIG. 9 is a perspective view of the frame assembly of FIG. 1 together with strike jamb and header frame elements for use in a door frame.

In yet another implementation, the elongate hinge reinforcement member 20 may be substantially the same length as the elongate frame jamb 40, as shown in FIGS. 7A, 7B, and 7C. By substantially the same length, it is meant that the elongate frame jamb 40 is at least long enough to extend from the jamb base end 48 beyond the top of the jamb hinge aperture most proximate to the jamb top end 52. By implementing the elongate hinge reinforcement member 20 as a continuous member, the elongate hinge reinforcement member 20 may be capable of vertically supporting the frame assembly 10 when mounted substantially vertically and positioning the elongate hinge reinforcement member 20 to rest its reinforcement base end 26 upon a floor (not shown). The elongate hinge reinforcement member 20 may also support the weight and other forces associated with the hanging and operation of a hinge-mounted door or window having its hinge assembly 60 mounted to the elongate hinge reinforcement member 20, instead of having to translate all such forces through the elongate frame jamb to the partition wall 70. Any difference in length between the elongate frame jamb 40 and the elongate hinge reinforcement member 20 is preferably not more than the height of an elongate frame header 120, shown in FIG. 9, mountable to the front jamb wall 42 at the jamb top end 52. The elongate frame header 120 may act as a top element of the frame assembly 10 installed in a wall opening. To complete the installed frame assembly 10, an elongate frame strike 130 or mullion, also shown in FIG. 9, similar in dimensions to the elongate frame jamb 40 may be mounted to a second partition wall (not shown), opposing the partition wall 70. The elongate frame header 120 may also be mounted to a top end of the elongate frame strike 130 and frame assembly 10 by header mounting fasteners (not shown). The header mounting fasteners may be screwed into longitudinal guide ribs 86 (shown in FIG. 3). In order to improve the fire-resistivity of the frame assembly 10, additional elongate reinforcement members similar in shape and composition to the elongate hinge reinforcement member 20 may be disposed within the elongate frame header 120 and the elongate frame strike 130 respectively. An elongate strike reinforcement member (not shown), similar in configuration to elongate hinge reinforcement member 20, may also be disposed within elongate frame strike 130 to support the frame assembly 10 and a strike plate (not shown) secured to the elongate strike reinforcement member through a strike aperture (not shown) in the elongate frame strike 130.

The elongate hinge reinforcement member 20 may be secured to the elongate frame jamb 40 by a variety of methods. In one implementation the elongate hinge reinforcement member 20 may be secured to the elongate frame jamb 40 by cold weld. In another implementation, glue may be applied to either the elongate hinge reinforcement member 20 or the elongate frame jamb 40 prior to disposing the elongate hinge reinforcement member 20 within the jamb longitudinal channel 50. The glue may be preferably applied to the front reinforcement wall 30 to be facing the front jamb wall 42, from the reinforcement base end 26 to the reinforcement top end 28, on either side of the longitudinal guide notch 87, and optionally also along the side reinforcement walls 32 facing the intermediate jamb wall 44 and end jamb wall 45.

In an implementation, the front jamb wall 42 is integrally molded with the intermediate jamb walls 44 and the end jamb wall 45, as shown in FIG. 3. In this way, the elongate frame jamb may be made of a solid continuous piece of material, such as steel, aluminium, wood, plastic, or other material.

Figure 10C:
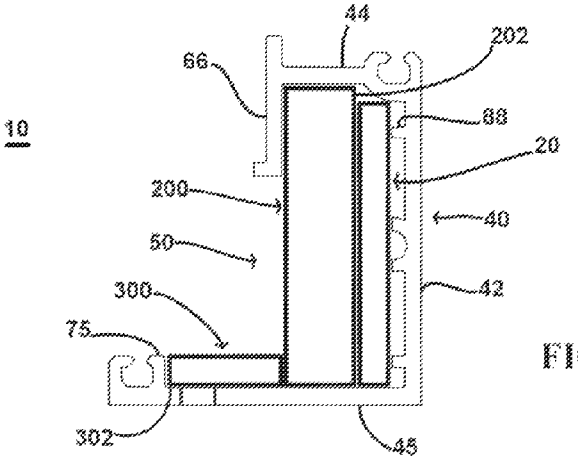
FIG. 10C is a partial top plan view of an implementation of the frame assembly of assembly of present invention.

Likewise, in another implementation, the front reinforcement wall may be integrally 30 molded with the side reinforcement walls 32 as shown in FIG. 4. While the shape of the member 20 and jamb 30 may be preferable, other variations of configuration of are possible without departing from the scope of the invention. In particular, there may be different preferred configurations of elongate hinge reinforcement member 20 depending on the material or materials used as described in the following examples. FIG. 10A shows an implementation where the hinge reinforcement member is made of a continuous piece of aluminium. As aluminium is softer than some other metals, the elongate hinge reinforcement member 20 may include a thicker portion of aluminium proximate the longitudinal guide notch 87 in order to maintain sufficient strength to support the frame assembly 10. The aluminium, and any of the metals described, may be bent, forged, or extruded into the shape shown.

Figure 10B:
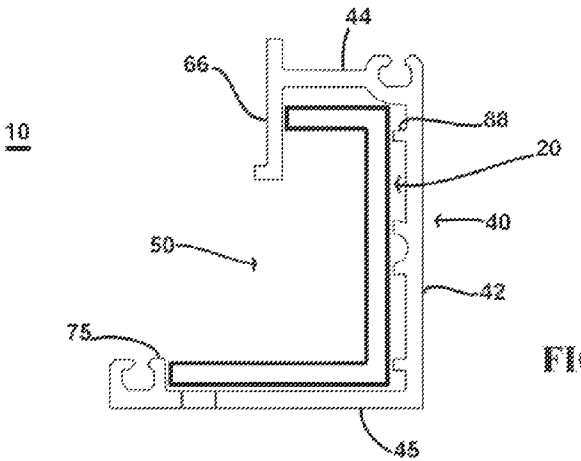
FIG. 10B is a partial top plan view of an implementation of the frame assembly of assembly of present invention.
Figure 10A:
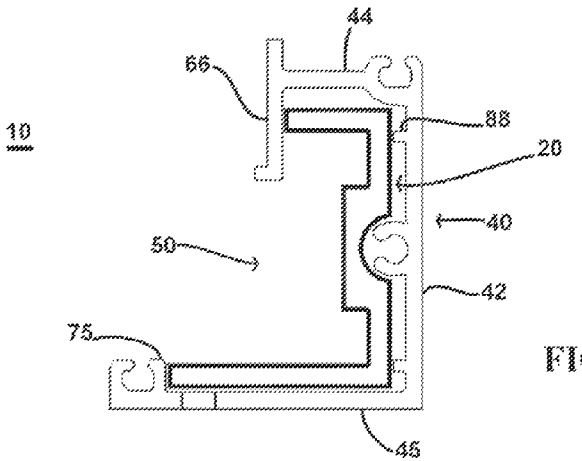
FIG. 10A is a partial top plan view of an implementation of the frame assembly of assembly of present invention.

FIG. 10B shows an implementation where the elongate hinge reinforcement member is made of a continuous piece of steel. In order to increase the support ability of the hinge reinforcement member 20 when made of steel, it may be preferable to not include the longitudinal guide notch 87. Accordingly, the longitudinal guide rib 86, if present, should be cut to the same level as any guide butts 88 present at the front jamb wall 42 in the jamb longitudinal channel 50.

In another implementation, as shown in FIG. 10C, the frame assembly 10 may further comprise a second elongate hinge reinforcement member 200 being secured between the elongate hinge reinforcement member 20 and the jamb stud mounting wall 66 where the jamb stud mounting wall 66 extends towards the jamb end wall 45 beyond the one of the intermediate walls 44 forming the jamb longitudinal channel 50. The second elongate hinge reinforcement member 200 may include a second reinforcement base end (not shown), a second reinforcement top end (not shown), and a second front reinforcement wall 202 extending between the second reinforcement base end and the second reinforcement top end. The entirety of the second elongate hinge reinforcement member 200 may be disposed within the jamb longitudinal channel 50. The frame assembly 10 may be further supportable by the second elongate hinge reinforcement member 200 at the second reinforcement base end. In this implementation, the second elongate hinge reinforcement member 200 may be made of wood, while the elongate hinge reinforcement member 20 may be made of steel where each member 20 and 200 is secured to one another by weld, glue, or other means. Preferred woods may include birch, maple, oak, pine, and finger jointed pine, and the elongate hinge reinforcement member 20 may be made of 10 gauge flat bar steel. Optionally, also as shown in FIG. 10C, the frame assembly 10 may further comprise a third elongate hinge reinforcement member 300 being secured between the second elongate hinge reinforcement member 200 and the abutment 75 formed in the end jamb wall 45. The third elongate hinge reinforcement member 300 may include a third reinforcement base end (not shown), a third reinforcement top end (not shown), and a third front reinforcement wall 302 extending between the third reinforcement base end and the third reinforcement top end. The entirety of the third elongate hinge reinforcement member may be disposed within the jamb longitudinal channel 50. The frame assembly 10 may be further supportable by the third elongate hinge reinforcement member 300 at the third reinforcement base end 304. In this implementation, the third reinforcement member 300 may be made of aluminium, plastic, wood, steel, or other material, and the third front reinforcement wall 302 may be disposed against the end jamb wall 45. The third front reinforcement wall 302 may be preferably secured to the end jamb wall 45 by glue or cold weld.

Figures 10D, 10E, 10F, 10G:
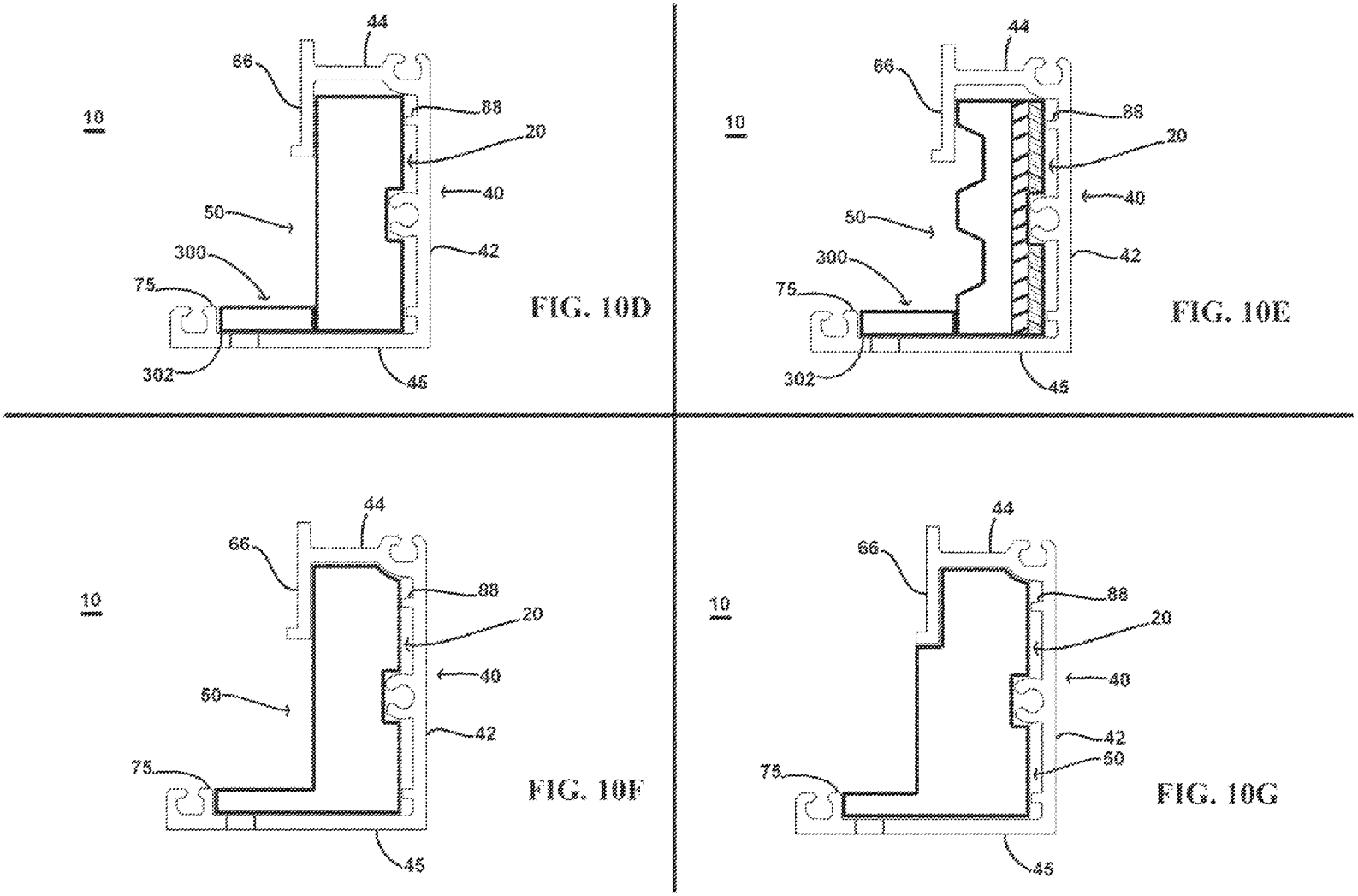
FIG. 10D is a partial top plan view of an implementation of the frame assembly of assembly of present invention.
FIG. 10E is a partial top plan view of an implementation of the frame assembly of assembly of present invention.
FIG. 10F is a partial top plan view of an implementation of the frame assembly of assembly of present invention.
FIG. 10G is a partial top plan view of an implementation of the frame assembly of assembly of present invention.

FIG. 10D shows another implementation where the frame assembly 10 employs the elongate hinge reinforcement member 20 and the third elongate hinge reinforcement member 300, but not the second elongate hinge reinforcement member 200. In this implementation, the elongate hinge reinforcement member 20 is of substantially uniform thickness throughout its width, except at the longitudinal guide notch 87. It may be preferably to construct the elongate hinge reinforcement member 20 when using wood. In order to provide additional support, the third elongate hinge reinforcement member 300 may be provided as described in relation to FIG. 10.

FIG. 10E shows another implementation where the frame assembly 10 employs the elongate hinge reinforcement member 20 and the third elongate hinge reinforcement member 300, but not the second elongate hinge reinforcement member 200. In this implementation, the elongate hinge reinforcement member 20 may be formed of layers of recycled tire made from strips, pellets, or other fill. In order to provide additional support, the third elongate hinge reinforcement member 300 may be provided as described in relation to FIG. 10.

FIG. 10F shows another implementation where the frame assembly 10 employs the elongate hinge reinforcement member 20 only, but not the third elongate hinge reinforcement member 300 or the second elongate hinge reinforcement member 200. In this implementation, the elongate hinge reinforcement member 20 may be formed of ultra dense plastic, such as phenolic plastic. The plastic may be molded to substantially the same shape as the jamb longitudinal channel 50, including side reinforcement wall 32 disposed proximate the end jamb wall 45 extending between the front jamb wall 42 and the end jamb wall abutment 75.

FIG. 10G shows another implementation where the frame assembly 10 employs the elongate hinge reinforcement member 20 only, but not the third elongate hinge reinforcement member 300 or the second elongate hinge reinforcement member 200. In this implementation, the elongate hinge reinforcement member 20 may be formed of recycled plastic. The plastic may be molded to substantially the same shape as the jamb longitudinal channel 50, including side reinforcement wall 32 disposed proximate the end jamb wall 45 extending between the front jamb wall 42 and the end jamb wall abutment 75. As recycled plastic may not be as strong as ultra dense plastic, the elongate hinge reinforcement member 20 may be formed to be as thick as possible, thereby extending to be substantially flush with the jamb stud mounting wall 66 as shown in FIG. 14.

In another implementation, the frame assembly 10 may include an elongate frame jamb 40 and an elongate hinge reinforcement member 20. The elongate frame jamb 40 may include a front jamb wall 42, a jamb stud mounting wall 66 configured to mount the frame assembly 10 to a partition wall 70, at least one intermediate jamb walls 44 extending between the jamb stud mounting wall 66 and the front jamb wall 42, and an end jamb wall 45 extending from the front jamb wall 42 and being opposite one of the intermediate jamb walls 44. The front jamb wall 42, the one intermediate jamb wall 44, and the end jamb wall 45 form a jamb longitudinal channel 50. The elongate hinge reinforcement member 20 may be retained within and secured to the jamb longitudinal channel 50. The elongate hinge reinforcement member 20 includes a front reinforcement wall 30 and a pair of spaced-apart side reinforcement walls 32 extending from the front reinforcement wall 30. The front reinforcement wall 30 may include a set of mounting holes 24 for securing the hinge plate 62 thereto. The mounting holes 24 may be located substantially equidistant between the side reinforcement walls 32. In another implementation, the front reinforcement wall 30 may be substantially the same length as the front jamb wall 42. Preferably, the front jamb wall 42 may include at least one jamb hinge aperture 46 for receiving hinge plate 62 therein, and the mounting holes are aligned with the jamb hinge aperture 46.

Although the invention has been described in detail with reference to certain particular implementations, the invention is capable of other embodiments and of being practiced and carried out in various ways without departing from the scope of the invention. Accordingly, the scope of the claims should not be limited to the preferred embodiments set forth in the examples, but should be given the broadest interpretation consistent with the description as a whole. Other parts may be used when combining one or more windows to the frame assembly 10 in a door frame providing for a side light, which may be further supportable by the elongate hinge reinforcement member 20.

What is claimed is:

1. A frame assembly comprising:

an elongate frame jamb comprising:

a jamb base end, a jamb top end, and a front jamb wall extending between the jamb base end and the jamb top end;

at least one intermediate jamb wall extending from the front jamb wall; and an end jamb wall extending from the front jamb wall and being opposite one of the intermediate jamb walls, the front jamb wall, the one intermediate jamb wall, and the end jamb wall forming a jamb longitudinal channel; and an elongate hinge reinforcement member retained within the jamb longitudinal channel and comprising a reinforcement base end, a reinforcement top end, and a front reinforcement wall extending between the reinforcement base end and the reinforcement top end, the elongate hinge reinforcement member being secured to the elongate frame jamb such that the elongate frame jamb is vertically supportable by the elongate hinge reinforcement member at the reinforcement base end, wherein said hinge reinforcement member is made of a single piece of material.

2. The frame assembly of claim 1, wherein the elongate frame jamb includes a jamb stud mounting wall and a pair of the intermediate jamb walls, the jamb stud mounting wall being configured to mount the frame assembly to a partition wall, the intermediate jamb walls being spaced-apart and extending between the jamb stud mounting wall and the front jamb wall.

3. The frame assembly of claim 2, wherein the spaced-apart intermediate jamb walls define an elongate jamb channel therebetween, the elongate jamb channel being configured to receive a door jamb stop therein.

4. The frame assembly of claim 2, wherein the entirety of the elongate hinge reinforcement member is disposed within the jamb longitudinal channel, the front reinforcement wall is disposed against the front jamb wall, and the reinforcement base end is substantially aligned with the jamb base end.

5. The frame assembly of claim 2, wherein the elongate hinge reinforcement member further comprises a pair of spaced-apart side reinforcement walls, the side reinforcement walls extending from the front reinforcement wall and being disposed against one of the at least one intermediate jamb walls and the end jamb wall.

6. The frame assembly of claim 5, wherein the front jamb wall further comprises at least one jamb hinge aperture for receiving a hinge plate therein, the elongate hinge reinforcement member further comprises a set of mounting holes for securing the hinge thereto, and the mounting holes are aligned with the jamb hinge aperture.

7. The frame assembly of claim 6, wherein the mounting holes are located substantially equidistantly between the side reinforcement walls.

8. The frame assembly of claim 6, wherein the elongate hinge reinforcement member is disposed offset from a midpoint of the elongate frame jamb.

9. The frame assembly of claim 5, wherein one of the side reinforcement walls is gripped between the jamb stud mounting wall and the front jamb wall.

10. The frame assembly of claim 5, wherein one of the side reinforcement walls is gripped between the front jamb wall and an abutment formed in the end jamb wall.

11. The frame assembly of claim 2, wherein the jamb stud mounting wall extends towards the jamb end wall beyond one of the intermediate walls and further defining the jamb longitudinal channel.

12. The frame assembly of claim 11, wherein the end jamb wall extends from the front jamb wall farther than either of the intermediate jamb walls.

13. The frame assembly of claim 2, further comprising a second elongate hinge reinforcement member comprising a second reinforcement base end, a second reinforcement top end, and second front reinforcement wall extending between the second reinforcement base end and the second reinforcement top end, wherein the jamb stud mounting wall extends towards the jamb end wall beyond the one of the intermediate walls forming the jamb longitudinal channel, an entirety of the second elongate hinge reinforcement member is disposed within the jamb longitudinal channel, the second elongate hinge reinforcement member being secured between the elongate hinge reinforcement member and the jamb stud mounting wall, the frame assembly being further supportable by the second elongate hinge reinforcement member at the second reinforcement base end.

14. The frame assembly of claim 13, further comprising a third elongate hinge reinforcement member comprising a third reinforcement base end, a third reinforcement top end, and a third front reinforcement wall extending between the third reinforcement base end and the third reinforcement top end, wherein an entirety of the third elongate hinge reinforcement member is disposed within the jamb longitudinal channel, the third elongate hinge reinforcement member being secured between the second elongate hinge reinforcement member and an abutment formed in the end jamb wall, the frame assembly being further supportable by the third elongate hinge reinforcement member at the third reinforcement base end.

15. The frame assembly of claim 1, wherein the elongate hinge reinforcement member is substantially the same length as the elongate frame jamb.

16. The frame assembly of claim 1, wherein the elongate hinge reinforcement member is secured to the elongate frame jamb by glue.

17. The frame assembly of claim 1, wherein the front jamb wall is integrally molded with the intermediate jamb walls and the end jamb wall.

* * * * *